United States Patent [19]

Belden et al.

[11] 4,450,891

[45] May 29, 1984

[54] METHOD OF AND APPARATUS FOR CONTINUOUS CASTING USING AN AUXILIARY GRAPHITE CHILL ROLL

[75] Inventors: Reed H. Belden, Bernardsville; Hsin L. Li, Parsippany; Dulari L. Sawheny, Denville, all of N.J.

[73] Assignee: Allied Corporation, Morris Township, Morris County, N.J.

[21] Appl. No.: 395,176

[22] Filed: Jul. 6, 1982

Related U.S. Application Data

[63] Continuation of Ser. No. 183,520, Sep. 2, 1980, abandoned.

[51] Int. Cl.[3] ..... B22D 11/06

[52] U.S. Cl. ..... 164/463; 164/423; 164/429; 164/479

[58] Field of Search ..... 164/423, 427, 429, 463, 164/479

[56] References Cited

U.S. PATENT DOCUMENTS 3,881,542 5/1975 Polk et al. ..... 164/423 X 3,938,583 2/1976 Kavesh ..... 164/423

*Primary Examiner*—Nicholas P. Godici

*Assistant Examiner*—J. Reed Batten, Jr.

*Attorney, Agent, or Firm*—James Riesenfeld; Gerhard H. Fuchs

[57] ABSTRACT

An improved apparatus and process is provided for producing solid metal strip from a molten source using a rapidly moving quench surface. The improvement comprises an auxiliary, liquid-cooled chill roll for contacting the solid strip and urging it against the quench surface. The invention permits high quench rates and improved strip surface smoothness to be achieved and finds particular advantage in the casting of metallic glass alloys.

7 Claims, 3 Drawing Figures

METHOD OF AND APPARATUS FOR CONTINUOUS CASTING USING AN AUXILIARY GRAPHITE CHILL ROLL

This application is a continuation of application Ser. No. 183,520, filed Sept. 2, 1980, now abandoned.

BACKGROUND OF THE INVENTION

1. Field of the Invention

This invention relates to an improved apparatus and method for continuous casting of metallic strip, particularly strip of metallic glass alloys.

2. Description of the Prior Art

For purposes of the present invention, a strip is a slender body whose transverse dimensions are much less than its length, including wire, ribbon, filament, and sheet, of regular or irregular cross section.

Several methods for making metal strip directly from the molten metal are known. For example, molten metal may be dropped between a pair of rapidly rotating rollers that are held together under pressure. The metal solidifies while passing between the rollers and forms a thin strip (H. S. Chen et al., Rev. Sci. Instrum. 41, 1237 (1970)).

Another method for casting metal strip is "jet casting," in which a stream of molten metal is directed against a moving quench surface, whereon it is solidified. This method was described by Strange and Pim in U.S. Pat. No. 905,758. In the procedure described by Strange and Pim, the quench surface is furnished by a rotating chill wheel. That procedure may be used to form strip of many of the polycrystalline metals that have a sharp melting point; i.e., a solid-liquid transition range of less than about 5° C. However, glassy metals, having an amorphous molecular structure, often have a transition range of about 400° C. or more, through which the viscosity of the metal gradually increases until the critical glass transition temperature is reached, and it is necessary for the filament to be quenched below its glass transition temperature before it leaves the quench surface. Generally, a quench rate of at least $10^{4}$° C./s at the solidification temperature is required to obtain metallic glass strip. This is difficult to achieve by the procedure of Strange and Pim because centrifugal action tends prematurely to fling the strip away from the chill wheel. Also, in that procedure the point of release of the filament from the surface of the chill wheel varies, so that it is difficult to collect the strip and guide it to a suitable winder.

Shortcomings concerning retention time of the strip on the surface of the chill wheel and difficulties in collecting the strip from a variable point of release are overcome by the procedures described by Kavesh in U.S. Pat. No. 3,856,074; Bendell in U.S. Pat. No. 3,862,658; and Carlson in U.S. Pat. No. 4,202,404. The Kavesh procedure involves retention of strip formed on the exterior surface of a rotating chill wheel by use of nipping means; the Bedell procedure involves prolonging the period of contact between the strip and the chill wheel by exerting a radial force against the surface of the chill wheel by devices such as gas jets, moving metal belts, and rotating wheels; and the Carlson procedure involves the use of an elastomeric "hugger belt."

These casting methods of the prior art provide a quench rate limited by the fact that the solidified strip is essentially quenched on one side only; i.e., the side in contact with the quench surface. The other ("upper") side is not quenched directly, either because it is in contact with a chill surface only as it solidifies (as in the dual-roller method of Chen et al.) or because it is in contact with a surface to which relatively little heat is transferred (as in the "retention" methods of Kavesh, Bedell, and Carlson).

Compared with the methods of the prior art, a method for removing heat from the upper surface of cast metal strip as it is being quenched could provide desirably higher quench rates. Alternatively, such a method could provide the same quench rate while permitting other parameters to be modified; for example, slower quench surface speed or thicker or wider strip.

SUMMARY OF THE INVENTION

In accordance with the present invention, there is provided an improved apparatus for the production of solid metal strip from a molten source using a rapidly moving quench surface. The improvement comprises an auxiliary, liquid-cooled chill roll for contacting the solid strip and urging it against the quench surface.

In operation, the present invention provides an improved method for the production of solid metal strip by impinging molten metal onto a rapidly moving quench surface. The improvement comprises cooling the strip just after it solidifies by pressing it against the quench surface with a liquid-cooled chill roll.

The apparatus and method of the present invention provide high quench rates ($10^{6}$° C./s), which are particularly advantageous for producing metallic glass alloy strip, and yield strip having a desirably smooth surface.

DETAILED DESCRIPTION OF THE INVENTION

In conventional processes for chill block casting of metal strip, quenching is accomplished by cooling the strip through the "underside," the side in contact with the quench surface. To provide the rapid quench rates necessary for producing metallic glass strip, improvements in chill block casting have provided more efficient cooling through the underside, without, however, providing appreciable direct cooling of the upper side beyond that which results from contact with the ambient air. The present invention provides direct cooling of the upper side by contacting this upper side with a liquid-cooled auxiliary chill roll. In addition, the pressure applied by the auxiliary chill roll improves the contact between the metallic strip and quench surface, thereby increasing the rate of heat transfer from the underside of the strip, as well.

Figure 1:
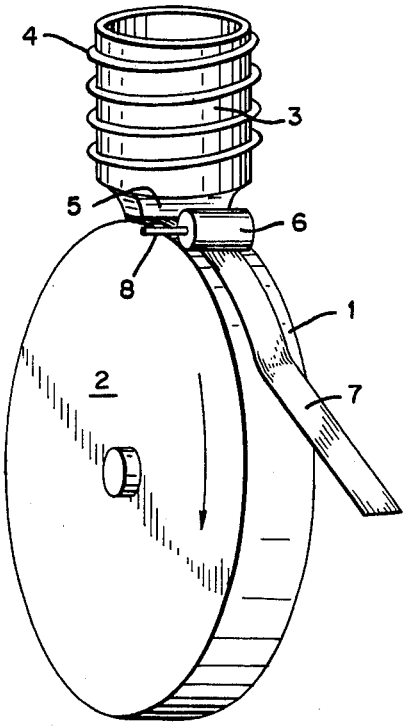
FIG. 1 is a simplified perspective view of an embodiment of the present invention in operation.

It is convenient to describe the invention in terms of the apparatus shown in FIG. 1, where the invention is depicted in an embodiment of the planar flow casting process disclosed by Narasimhan in U.S. Pat. No. 4,142,571.

In the drawings, elements depicted in more than one figure have the same reference number in each.

FIG. 1 provides a perspective view of an apparatus incorporating an auxiliary chill roll of the present invention. As shown there, the quench surface 1 is the rim of quench wheel 2, which is rotatably mounted on its longitudinal axis. Reservoir 3 for holding molten metal is equipped with induction heating coil 4 and is in communication with nozzle 5.

Figure 2:
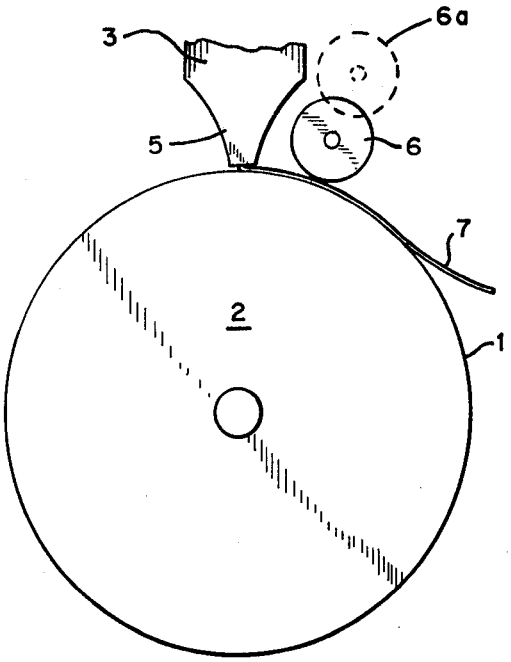
FIG. 2 is a side view of the apparatus of FIG. 1.

During start-up of the process, chill roll 6 is swiveled to a remote position 6*a*, as shown in FIG. 2. Molten metal maintained in reservoir 3 is ejected through nozzle 5 onto rotating quench surface 1, whereon it solidifies to form strip 7. Chill roll 6 is then moved toward quench surface 1 so that strip 7 is held between quench wheel 2 and chill roll 6. Attaching chill roll 6 to a piston in an air cylinder (not shown) provides a convenient means for moving the chill roll to and from remote position 6*a* and for controlling the force with which the chill roll is pressed into contact with strip 7. If the contact force is too small, slippage occurs and heat is generated by friction between the chill roll and strip. Preferably, the contact force is sufficiently great to minimize slippage so that the roll surface speed is about the same as the strip speed. Alternatively, chill roll 6 may be driven by separate, conventional means (not shown) so that its surface moves at substantially the same speed and direction as the quench surface at the point of closest approach of the surfaces.

Chill roll 6 is cooled by a coolant liquid that enters through inlet 8 and leaves through an outlet not shown. Although any conventional, high-temperature coolant liquid may be used, water is preferred on the bases of cost and convenience.

Ideally, chill roll 6 contacts strip 7 directly after the strip has solidified. In that case, the chill roll both enhances cooling and improves surface smoothness of the strip. If contact is made before solidification, the liquid may be prevented from passing under the chill roll, thus causing undesirable buildup of metal between the chill roll and nozzle. If contact is made too long after solidification, then the molecular structure of the strip is "frozen" while the metal cools uninfluenced by the chill roll. The result may be an undesirable crystalline structure.

The diameter of the chill roll is not a critical parameter; however, other considerations may constrain it to a narrow range, particularly if it is used in the planar flow casting process depicted in FIG. 1. Since that casting process requires that the gap between the nozzle outlet and quench surface be quite small, the chill roll diameter must be small enough that it does not contact the nozzle. On the other hand, a small chill roll diameter has at least two disadvantages. First, it has lower heat capacity and therefore provides less efficient cooling, all other things being equal. Secondly, a small-diameter roll must rotate at a higher rate to maintain surface speed at or near that of the quench surface. Higher rotation rates, in turn, put greater stress on the bearings supporting the chill roll.

The width of the chill roll is preferably about the same or greater than the strip width, since cooling efficiency is reduced when contact with the strip is not along its entire width.

Although planar flow casting is depicted in FIG. 1, it is clear that the present invention may also be used with other casting methods, such as jet casting and melt extraction, which are described by Kavesh in U.S. Pat. No. 3,938,583. Devices for retaining the strip in contact with the quench surface, such as the hugger belt of Carlson's U.S. Pat. No. 4,202,404, may be used in conjunction with the chill roll of the present invention. The quench surface need not be a wheel, as depicted in FIG. 1, but may also be another quench surface known in the art, such as an endless belt.

Figure 3:
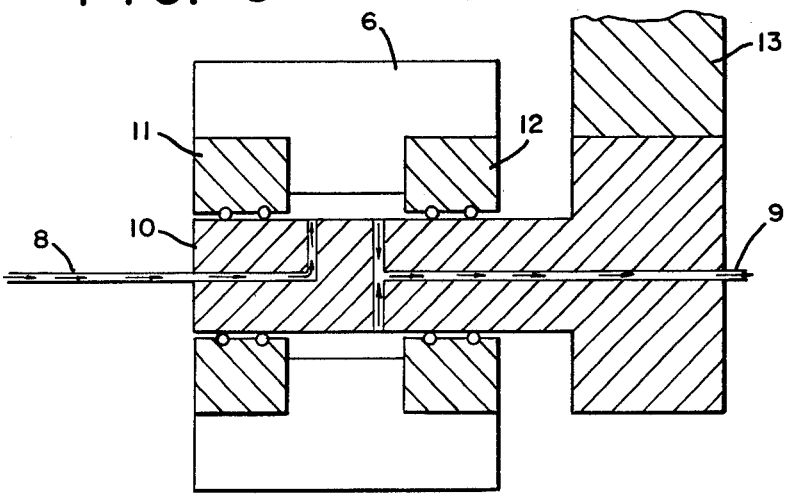
FIG. 3 is a cross-sectional view of an auxiliary chill roll of the present invention.

FIG. 3 shows chill roll 6 of FIG. 1 and its support in cross section. Stationary roll support 10 has through passages 8 and 9 for conveying coolant liquid to and from chill roll 6 and bearing supports 11 and 12. Support 10 is joined through arm 13 to a mechanism (not shown) for moving roll 6 against and away from quench wheel 2.

Choice of material for the chill roll is important. The material must be able to withstand temperatures in the range of about 800° to 1200° C.; i.e., slightly below the melting temperature of the strip. The material should be non-abrasive and have high thermal conductivity and low thermal expansion coefficient. Compared with the quench surface—typically beryllium copper or oxygen-free copper—the chill roll preferably comprises a material that is relatively soft, so that if particles of foreign material are trapped between the surfaces, the quench surface is not damaged. Preferably, the chill roll surface deforms elastically for improved contact with the strip and improved heat transfer to the roll. When it is harder than the strip, however, the chill roll better serves its function of deforming the strip and improving its surface smoothness. Optimum surface smoothness is achieved when contact with the chill roll is made before the strip reaches its final hardness and when soft strip is being cast. Suitable materials for the chill roll include graphite, graphite with fillers, fiber-impregnated graphite, and high-temperature-resistant elastomers, such as filled silicone elastomers. Graphite and graphite-based materials are preferred. The chill roll need not be all of one material; for example, the surface material may surround a core of another material.

The apparatus and method of the present invention are suitable for forming polycrystalline strip of aluminum, tin, copper, iron, steel, stainless steel and the like.

Metal alloys that, upon rapid ($10^5$° C./s) cooling from the melt, form solid amorphous structures are preferred. These are well known to those skilled in the art. Examples of such alloys are disclosed in U.S. Pat. Nos. 3,427,154; 3,981,722 and others.

The following Examples are presented in order to provide a more complete understanding of the invention. The specific techniques, conditions, materials, and reported data set forth to illustrate the principles and practice of the invention are exemplary and should not be construed as limiting the scope of the invention.

EXAMPLE 1

A metallic glass alloy $Fe_{81}B_{13.5}Si_{3.5}C_2$, was cast at 1350° C. with the apparatus shown in FIG. 1. The quench wheel was fabricated from beryllium copper with a diameter of 40 cm. The wheel rotation provided a surface speed of 15 m/s.

The auxiliary chill roller was machined from graphite having an apparent density of 1.7 g/cm$^3$, average porosity of 16% and useful temperature limit in air of about 400° C. The graphite roller had a diameter of 4.5 cm and length of 3.8 cm. The roller was supported on two bearings, each with an outside diameter of 3.1 cm and an inside diameter of 1.9 cm. The bearings were mounted on a 1.88 cm O.D. stainless steel shaft in which cooling tubes of 0.3 cm O.D.×0.1 cm I.D. were embedded as shown in FIG. 3. Before engaging the quench wheel, the graphite roller was located about 6 cm from the nozzle slot, measured along the quench wheel circumference, and 1 cm from the quench surface, measured in the radial direction. As soon as ribbon casting was started, an air piston was activated under pressure and through mechanical linkages pushed the graphite roller radially under 250 N force against the ribbon and, indirectly, against the quench surface. Simultaneously water under pressure flowed into the cooling tube at a rate of about 5 mL/s.

The strip produced was 25.4 mm wide by 0.032 mm thick and was characterized by high ductility and good magnetic properties. Ductility was measured by bending the strip around rods of decreasing diameter until the strip started to break. (The lower the diameter of bendbreak, the better the ductility.) The strip cast using the graphite roller was ductile, with a bend-break diameter of about 1 mm.

EXAMPLE 2 (Prior art comparison)

Example 1 was repeated with the exception that no graphite roller was used. The strip cast was less ductile, with a bend-break diameter of about 2.2 mm.

We claim:

1. In an apparatus for the production of solid metal strip from a molten source including a rapidly moving quench surface and means for impinging the molten metal onto the quench surface to form the solid metal strip, the improvement which comprises an auxiliary, liquid-cooled chill roll consisting essentially of graphite for contacting the solid strip and urging it against the quench surface.

2. The apparatus of claim 1 wherein the coolant liquid is water.

3. The apparatus of claim 1 wherein the quench surface is the surface of a wheel rotating about a substantially horizontal axis.

4. The apparatus of claim 1 wherein the quench surface is an endless belt.

5. The apparatus of claim 1 further comprising driving means for moving the chill roll surface at substantially the same speed and direction as the quench surface at the point of closest approach of the surfaces.

6. In a method for the production of solid metal strip by impinging molten metal onto a rapidly moving quench surface, the improvement which comprises cooling the strip just after it solidifies by pressing it against the quench surface with a liquid-cooled chill roll consisting essentially of graphite.

7. The method of claim 6 wherein the chill roll surface is driven to move at the same speed and direction as the quench surface at the point of closest approach of the surfaces.

* * * * *